US007708383B2

(12) United States Patent
Furukawa

(10) Patent No.: US 7,708,383 B2
(45) Date of Patent: May 4, 2010

(54) INK JET HEAD AND INK JET RECORDING APPARATUS

(75) Inventor: Koji Furukawa, Shizuoka (JP)

(73) Assignee: FUJIFILM Corporation, Kanagawa (JP)

( * ) Notice: Subject to any disclaimer, the term of this patent is extended or adjusted under 35 U.S.C. 154(b) by 274 days.

(21) Appl. No.: 11/078,357

(22) Filed: Mar. 14, 2005

(65) Prior Publication Data

US 2005/0200658 A1 Sep. 15, 2005

(30) Foreign Application Priority Data

Mar. 12, 2004 (JP) ..... 2004-070564

(51) Int. Cl.
*B41J 2/06* (2006.01)

(52) U.S. Cl. ..... 347/55; 347/54; 347/47

(58) Field of Classification Search ..... 347/55, 347/47, 54

See application file for complete search history.

(56) References Cited

U.S. PATENT DOCUMENTS 6,158,844 A * 12/2000 Murakami et al. ..... 347/55
6,507,001 B1 1/2003 Kubby
2001/0024219 A1* 9/2001 Kanda et al. ..... 347/47
2002/0122099 A1* 9/2002 Furukawa ..... 347/55
2002/0140774 A1* 10/2002 Miki et al. ..... 347/44

FOREIGN PATENT DOCUMENTS

| | | | |
|---|---|---|---|
| EP | 1055518 | A2 | 11/2000 |
| EP | 1386739 | A2 | 2/2004 |
| JP | 10-016238 | A | 1/1998 |
| JP | 10-138493 | A | 5/1998 |
| JP | 2000-203029 | A | 7/2000 |
| JP | 2003-225591 | A | 8/2003 |

* cited by examiner

*Primary Examiner*—Matthew Luu
*Assistant Examiner*—Henok Legesse
(74) *Attorney, Agent, or Firm*—Sughrue Mion, PLLC

(57) ABSTRACT

The ink jet head includes a plate-like substrate having an ejection port bored therethrough and an ejection unit for ejecting ink droplets from the port, wherein at least a part of a periphery of the port convexly projects along an ejection direction of the ink droplets. The head ejects the ink droplets from the port by causing an electrostatic force to act on ink containing charged colorant particles. The head includes an ejection port substrate as the plate-like substrate, a head substrate disposed apart from the port substrate to form an ink flow path, an ink guide that is provided in the head substrate and a tip portion of which penetrates through the port, and an ejection electrode formed in correspondence to the port and causing the electrostatic force to act on the ink. The ink jet recording apparatus records an image on a recording medium using the ink jet head.

14 Claims, 6 Drawing Sheets

INK JET HEAD AND INK JET RECORDING APPARATUS

This application claims priority on Japanese patent application No. 2004-070564, the entire contents of which are hereby incorporated by reference.

BACKGROUND OF THE INVENTION

The present invention relates to an ink jet head with which ink droplets are ejected from ejection ports formed in a substrate toward a recording medium, and an ink jet recording apparatus using the ink jet head.

An ink jet recording apparatus ejects ink through ejection ports to record an image corresponding to image data on a recording medium. Examples of known ink jet recording apparatuses include an electrostatic type, thermal type, and piezoelectric type ink jet recording apparatuses which are classified depending on differences of means for controlling ejection of ink.

Hereinafter, the electrostatic ink jet recording apparatus will be described as an example. In the electrostatic ink jet recording apparatus, ink containing charged colorant particles (charged color particles) is used, and predetermined voltages are respectively applied to ejection portions of an ink jet head in accordance with image data, whereby ejection of the ink from the ink jet head is controlled by utilizing electrostatic forces to record an image corresponding to the image data on a recording medium. Known as an example of the electrostatic ink jet recording apparatus is an ink jet recording apparatus disclosed in JP 10-138493 A.

FIG. 8 is a schematic view showing a construction of an example of an ink jet head of the electrostatic ink jet recording apparatus disclosed in JP 10-138493 A. In an ink jet head 100 shown in FIG. 8, only one ejection portion of the ink jet head disclosed in JP 10-138493 A is conceptually shown. The ink jet head 100 includes a head substrate 102, an ink guide 104, an insulating substrate 106, a control electrode 108, a counter electrode 110, a D.C. bias voltage source 112, and a pulse voltage source 114.

Here, the ink guide 104 is disposed on the head substrate 102, and a through hole (ejection port) 116 is bored through the insulating substrate 106 so as to correspond in position to the ink guide 104. The ink guide 104 extends through the through hole 116, and its projecting tip portion 104*a* projects upwardly and beyond a surface of the insulating substrate 106 on a side of a recording medium P. In addition, the head substrate 102 is disposed at a predetermined distance from the insulating substrate 106. Thus, a passage 118 of ink Q is defined between the head substrate 102 and the insulating substrate 106.

The control electrode 108 is provided in a ring-like shape on the surface of the insulating substrate 106 on the side of the recording medium P so as to surround the through hole 116 of every ejection portion. In addition, the control electrode 108 is connected to the pulse voltage source 114 for generating a pulse voltage in accordance with image data. The pulse voltage source 114 is grounded through the D.C. bias voltage source 112.

In addition, the counter electrode 110 is disposed at a predetermined distance from the ink guide 104 so as to face the tip portion 104*a* of the ink guide 104 and is grounded. The recording medium P is disposed on a surface of the counter electrode 110 on a side of the ink guide 104. That is to say, the counter electrode 110 functions as a platen for supporting the recording medium P.

During the recording, the ink Q containing colorant particles which are charged in the same polarity as that of a voltage applied to the control electrode 108 is circulated through the ink passage 118 from the right-hand side to the left-hand side in FIG. 8 by a circulation mechanism for ink (not shown). In addition, a high voltage of 1.5 kV for example is continuously applied to the control electrode 108 by the D.C. bias voltage source 112. At this time, the Coulomb attraction between the bias voltage applied to the counter electrode 110 and the electric charges of the colorant particles in the ink, the viscosity of the ink (dispersion medium), the surface tension, the repulsion among the charged particles, the fluid pressure when the ink is supplied, and the like operate in conjunction with one another. Thus, the balance is kept in a meniscus shape as shown in FIG. 8 in which the ink slightly rises from the ejection port (nozzle) 116.

In addition, the colorant particles migrate to move to the meniscus surface due to the Coulomb attraction or the like. In other words, the ink Q is concentrated on the meniscus surface.

If a pulse voltage of for example 0 V is applied from the pulse voltage source 114 to the control electrode 108 biased at 1.5 kV by the bias voltage source 112, then a voltage of 1.5 kV obtained by superposing both the voltages on each other is applied to the control electrode 108. In this state, an electric field strength in the vicinity of the tip portion 104*a* of the ink guide 104 is relatively low, and hence the ink Q that contains the colorant particles concentrated at the tip portion 104*a* of the ink guide 104 does not fly out from the tip portion 104*a* of the ink guide 104.

On the other hand, if a pulse voltage of for example 500 V is applied from the pulse voltage source 114 to the control electrode 108 biased at 1.5 kV, then a voltage of 2 kV obtained by superposing both the voltages on each other is applied to the control electrode 108. As a result, the ink Q containing the colorant particles which are concentrated at the tip portion 104*a* of the ink guide 104 flies out in the form of ink droplets R from the tip portion 104*a* of the ink guide 104 by the electrostatic force, is electrostatically attracted by the grounded counter electrode 110 and adheres to the recording medium P to form thereon a dot of the colorant particles.

In such a manner, recording is carried out with the dots of the colorant particles while the ink jet head 100 and the recording medium P supported on the counter electrode 110 are relatively moved to thereby record an image corresponding to the image data on the recording medium P.

Here, in the image recording with the ink jet head for ejecting ink droplets from the ejection ports, the meniscus needs to be stably formed in order to stably eject the ink droplets.

However, in the case of the ink jet recording apparatus disclosed in JP 10-138493 A, since the holding property of the formed meniscus is poor and thus the meniscus shape is not stabilized, the ejection performance fluctuates. For this reason, there is encountered a problem in that the drawing cannot be satisfactorily carried out.

In addition, when the holding property of the meniscus is poor, the formed meniscus is broken, and thus the ink overflows from the ejection port. As a result, there is also encountered a problem in that since the surface of the ejection port substrate gets dirty, the cleaning and maintenance for the surface of the ejection port substrate need to be carried out.

SUMMARY OF THE INVENTION

In light of the foregoing, the present invention has been made to solve the problems associated with the prior art. It is, therefore, an object of the present invention to provide an ink jet head which has a high meniscus holding property and which is capable of stably forming a meniscus and stably drawing image dots each having a desired size.

Another object of the present invention is to provide an ink jet recording apparatus using the ink jet head.

In order to solve the above-mentioned object, the present invention provides an ink jet head including a plate-like substrate having an ejection port bored through the plate-like substrate; and ejection means for ejecting ink droplets from the ejection port, wherein at least a part of a periphery of the ejection port convexly projects along an ejection direction of the ink droplets.

Here, an angle between a surface parallel with the ejection direction and an uppermost surface of a convexly-projecting portion of the periphery of the ejection port that convexly projects along the ejection direction is preferably an acute angle.

In addition, a tip portion of a convexly-projecting portion of the periphery of the ejection port that convexly projects along the ejection direction preferably has an acute angle.

Also, the ink droplets are preferably ejected from the ejection port by causing an electrostatic force to act on ink.

In addition, the present invention provides an ink jet head for ejecting ink droplets from an ejection port by causing an electrostatic force to act on ink containing charged colorant particles, comprising: an ejection port substrate having an ejection port bored through the ejection port substrate, the ink droplets being adapted to be ejected from the ejection port; a head substrate disposed at a predetermined distance apart from the ejection port substrate to form an ink flow path between the ejection port substrate and the head substrate; an ink guide provided in the head substrate in a position corresponding to the ejection port of the ejection port substrate, a tip portion of the ink guide penetrating through the ejection port; and an ejection electrode formed in correspondence to the ejection port for ejecting the ink droplets from the ejection port by causing the electrostatic force to act on the ink, wherein at least a part of a periphery of the ejection port convexly projects along an ejection direction of the ink droplets.

Here, an angle between a surface parallel with the ejection direction and an uppermost surface of a convexly-projecting portion of the periphery of the ejection port that convexly projects along the ejection direction is preferably an acute angle.

In addition, a tip portion of a convexly-projecting portion of the periphery of the ejection port that convexly projects along the ejection direction preferably has an acute angle.

Here, a height of the projecting portion is preferably a range of 10 μm or more, and 500 μm or less.

In addition, the present invention provides an ink jet recording apparatus for recording an image corresponding to image data on a recording medium using any one of the above ink jet heads.

According to the present invention, the meniscus holding property in the ejection port can be enhanced, and thus the ink can be prevented from overflowing from the ejection port. As a result, the maintenance property can be improved. Moreover, the meniscus shape is stabilized, so the image dot drawing performance is also stabilized, and thus the image dots having a uniform dot diameter can be consistently drawn.

BRIEF DESCRIOTION OF THE DRAWINGS

DETAILED DESCRIPTION OF THE PREFERRED EMBODIMENTS

An ink jet head and an ink jet recording apparatus using the ink jet head according to the present invention will hereinafter be described in detail based on preferred embodiments illustrated in the accompanying drawings.

Figure 1A:
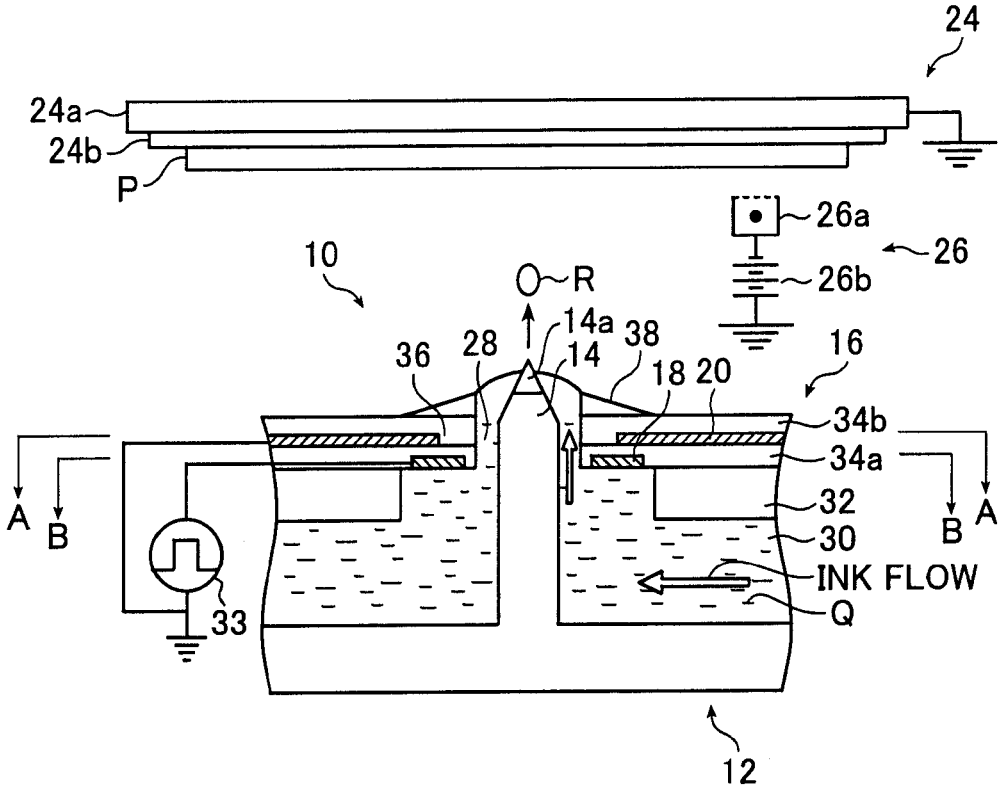
FIG. 1A is a schematic cross-sectional view of an ink jet head according to an embodiment of the present invention.
Figure 1B:
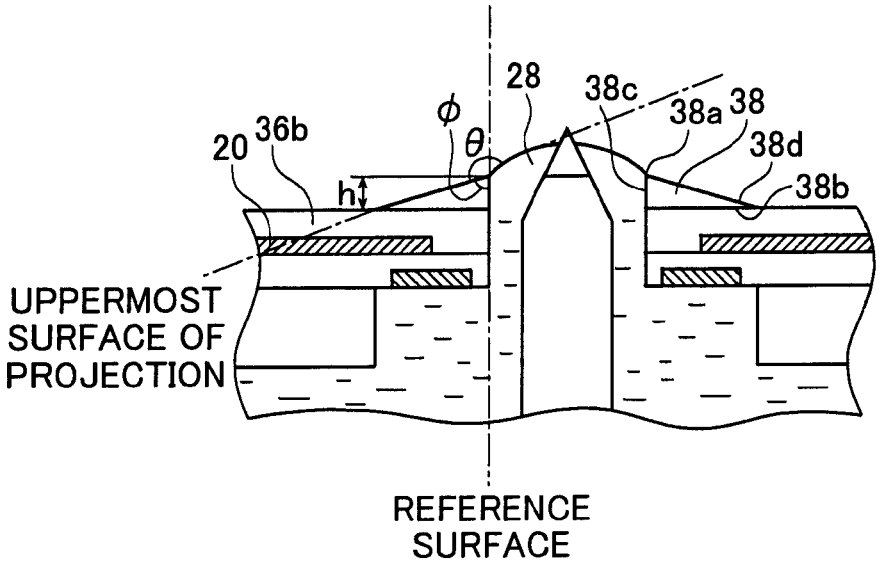
FIG. 1B is an enlarged view showing the periphery of an ejection port of the ink jet head shown in FIG. 1A.
Figure 2A:
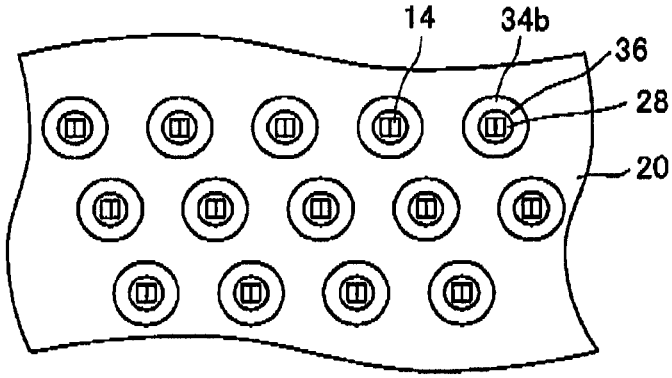
FIGS. 2A and 2B are conceptual views illustrating the ink jet head shown in FIG. 1A.
Figure 2B:
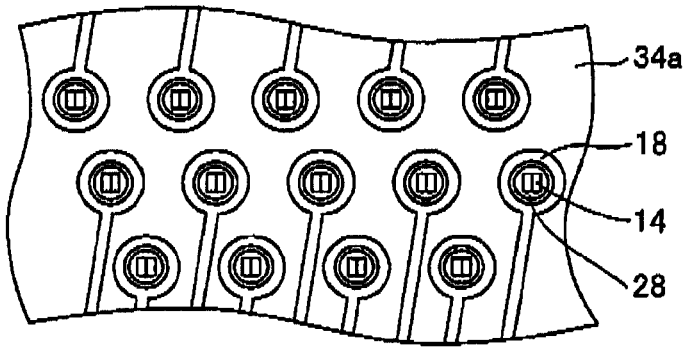
Figure 3:
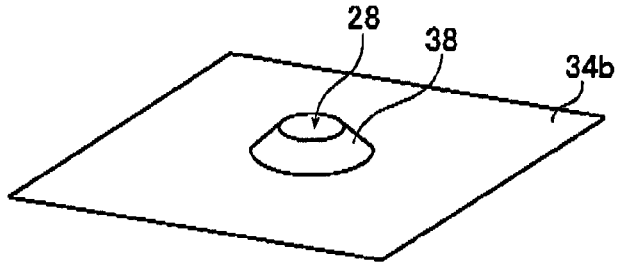
FIG. 3 is a perspective view showing the shape of a projection in the ink jet head shown in FIG. 1A.

FIG. 1A is a schematic cross-sectional view of an ink jet head according to an embodiment of the present invention, and FIG. 1B is an enlarged view showing the periphery of an ejection port of the ink jet head shown in FIG. 1A. FIGS. 2A and 2B are cross sectional views taken along the line A-A and the line B-B of FIG. 1A. FIG. 3 is a perspective view of an ejection port substrate.

An electrostatic ink jet head 10 shown in these drawings includes a head substrate 12, ink guides 14, an ejection port substrate 16 having ejection ports 28, ejection electrodes 18 formed on the periphery of the ejection ports 28 in the ejection port substrate 16, and a guard electrode 20 provided on the upper side in FIG. 1A of the ejection electrodes 18 inside the ejection port substrate 16. As will be described later in detail, an insulating substrate 32 is covered with a first insulating layer 34*a*, which in turn is covered with a second insulating layer 34*b* to thereby form the ejection port substrate 16. Further, a projection 38 is formed on the second insulating layer 34*b* of the ejection port substrate 16 at a position where the layer 34*b* surrounds the ejection port 28.

The head substrate 12 and the ejection port substrate 16 are disposed apart from each other by a predetermined distance, and the gap defined by those substrates 12, 16 forms an main ink flow path 30 for supplying ink to each ejection port 28. The main ink flow path 30 and each ejection port 28 extending to the opening end on the ejection side form an ink flow path.

A counter electrode 24 which supports a recording medium P and a charge unit 26 for the recording medium P are disposed so as to be opposed to the ejection portions of the ink jet head 10 (more specifically, ejection ports (nozzles) 28, ink guides 14 and ejection electrodes 18).

The ink jet head 10 described above ejects ink Q prepared by dispersing charged fine particles containing a pigment or other colorant component (hereinafter referred to as colorant particles) into an insulating liquid (carrier liquid) under an electrostatic force. The drive voltage to be applied to the ejection electrode 18 for ejection ON/OFF is controlled in accordance with image data, whereby ink droplets are modulated in accordance with the image data and ejected to record an image on the recording medium P.

As shown in FIGS. 2A and 2B, the ink jet head 10 has a multi channel structure where the ejection portions are arranged two-dimensionally for high density image recording. However, in order to clearly represent the structure, FIG. 1A shows only one ejection portion.

In the ink jet head 10 according to the present invention, it is possible to freely choose the number of the ejection electrodes 18 and the physical arrangement thereof. For example, the structure may be the multi channel structure of the embodiment shown in FIG. 2A or 2B or a structure having only one line of the ejection portions. The ink jet head 10 may be a so-called (full-)line head having lines of ejection portions corresponding to the whole area of the recording medium P or a so-called serial head (shuttle type head) which performs scanning in a direction perpendicular to the nozzle row direction. The ink jet head 10 of the present invention can cope with a monochrome recording apparatus and a color recording apparatus.

In the illustrated ink jet head 10, the ink guide 14 is formed of a ceramic flat plate with a predetermined thickness having a convex tip end portion 14*a*, and disposed on the head substrate 12 for each ejection port 28 (ejection portion).

Through-holes serving as the ejection ports 28 for ejecting ink droplets R are formed in the ejection port substrate 16 to be described later. The ink guides 14 are disposed in the respective ejection ports 28 (ejection portions) and their tip end portions 14*a* project from the surface of the ejection port substrate 16 on the recording medium P side. For the sake of convenience, the surfaces of the insulating layer 34*b* on the upper side and the lower side in FIG. 1A are hereinafter referred to as the upper and lower surfaces, respectively. Note that a slit functioning as an ink guide groove for guiding the ink Q to the tip end portion 14*a* through the capillary phenomenon may be formed in the top-bottom direction on the paper plane of FIG. 1A in a center portion of the ink guide 14.

In the illustrated case, the ink guide 14 on the tip end portion 14*a* side is processed to be upwardly tapered and to have a substantially triangular shape (or a trapezoidal shape). The shape of the ink guide 14 is not particularly limited as long as the ink Q, more specifically, the charged fine particle component in the ink Q is allowed to pass through the ejection port 28 of the ejection port substrate 16 and to be concentrated at the tip end portion 14*a*. For example, the tip end portion 14*a* is not necessarily convex but the shape may be appropriately changed, and a known shape can be used as well.

A metal is preferably vapor-deposited onto a distal end portion of the ink guide 14. With the vapor-deposition of the metal, the tip end portion 14*a* of the ink guide 14 has practically large permittivity to facilitate generation of an intense electric field, thereby improving ink ejection properties.

As described above, the head substrate 12 and the ejection port substrate 16 are disposed apart from each other by a predetermined distance, and the gap defined by those substrates 12, 16 forms the main ink flow path 30 which functions as an ink reservoir (ink chamber) for supplying the ink Q to each ejection port 28 (ink guide 14).

During image recording, the ink Q is circulated by an ink circulating mechanism (not shown) in a predetermined direction (the ink is circulated in the main ink flow path 30 from the right to the left in the illustrated case) at a predetermined speed (for example, at an ink flow rate of 200 mm/s).

The ejection port substrate 16 includes the insulating substrate 32, the first insulating layer 34*a* having the ejection electrodes 18 formed on its lower side, and the second insulating layer 34*b* having the guard electrode 20 formed on its lower side and the projection 38 formed on its upper side. The ejection port 28 for ejecting the ink droplets R is formed so as to perfectly extend through the ejection port substrate 16. The ink guide 14 is inserted through each ejection port 28 so as for its tip end portion to project upwardly. Here, the ejection electrodes 18 and the projections 38 are formed in the ejection ports 28 of the ejection port substrate 16. Moreover, the guard electrode 20 is formed above the ejection electrodes 18 and between the ejection electrodes 18.

In the illustrated ink jet head 10, the ejection port substrate 16 has such a construction that the ejection electrodes 18 are formed on the upper surface of the insulating substrate 32 made of an insulating material, the first insulating layer 34*a* is formed so as to cover the whole upper surface of the insulating substrate 32, the guard electrode 20 is formed on the upper surface of the first insulating layer 34*a*, the insulating layer 34*b* is formed so as to cover the whole upper surface of the first insulating layer 34*a*, and thereafter, an area of the insulating substrate 32 corresponding to the ejection electrodes 18 is removed by utilizing a known etching technique for example.

Consequently, in the illustrated ink jet head 10, the lower surfaces of the ejection electrodes 18 are exposed to the main ink flow path 30 constituted by the gap between the head substrate 12 and the ejection port substrate 16 with the ejection electrodes 18 being buried in the first insulating layer 34*a* on its lower surface side. That is, the lower surfaces of the ejection electrodes 18 contact the ink Q in the main ink flow path 30.

In addition, as described above, the ejection port substrate 16 has the projection 38 on the upper surface of the second insulating layer 34*b* on the periphery of each ejection port 28. As shown in FIG. 3, the projection 38 has a shape which is obtained by removing a portion corresponding to the ejection port 28 from a cone having the base on the upper surface of the second insulating layer 34*b* and having a vertex on the central axis of the ejection port 28. That is, as shown in FIG. 1B, the cross-sectional shape of the projection 38 is a triangular shape in which the lower surface of the projection 38 contacting the second insulating layer 34*b* corresponds to a base 38*b*, the side surface of the projection 38 as a part of the ejection port 28 corresponds to an opposite side 38*c*, and the upper surface of the projection 38 having an inclination which gets closer to the recording medium P as the distance from the ejection port 28 is decreased corresponds to a hypotenuse 38*d*.

A tip portion 38*a* of the projection 38 has a sharp shape. That is, the angle Φ at a joining point between the opposite side 38*c* and the hypotenuse 38*d* of the projection 38 is an acute angle. The projection 38 has a predetermined height. Note that the height of the projection 38 means a height h from the upper surface of the second insulating layer 34*b* as a portion in which the ejection port substrate 16 does not project to the tip portion 38*a* of the projection 38.

In the present invention, as described above, the periphery of the ejection port 28 has the projection 38 in which the tip portion 38*a* on the recording medium P side has an acute angle, whereby the meniscus holding property is enhanced, and the stable ejection of the ink droplets is greatly enhanced. This point will be described in detail later together with an operation of the ejection of the ink droplets.

As shown in this embodiment, a part of the periphery of the ejection port 28 on the lower surface side of the ejection port substrate 16 is preferably removed by a predetermined thickness. In this way, the length of the ejection port 28 can be shortened, the resistance between the ink Q and the inner wall of the ejection port 28 is reduced, and the ink Q can be speedily ejected from the ejection port 28. The ejection port substrate 16 preferably has the shape in which a part of the periphery of the ejection port 28 corresponding to the insulating substrate 32 is removed as in the illustrated case. However, the ejection port substrate 16 may also have a shape in which a part of the ejection port substrate 16 is not removed.

Each of the ejection electrodes 18 is disposed as a ring-like circular electrode on the lower surface of the first insulating layer 34*a* (the surface on the head substrate 12 side) and on the upper side of the insulating substrate 32 in FIG. 1A (the surface on the recording medium P side) so as to surround the ejection port 28 extending through the ejection port substrate 16. The ejection electrode 18 is connected to a signal voltage source 33 for generating a drive voltage (e.g., a pulse voltage) having a predetermined electric potential and corresponding to ejection data (ejection signal) such as image data or printing data.

Since, as described above, the illustrated embodiment has a multi-channel structure in which the ejection ports 28 are two-dimensionally disposed, the ejection electrodes 18, as a matter of course, are two-dimensionally disposed in the ejection ports 28 as shown in FIG. 2B.

Here, the ejection electrode 18 contacts the ink Q. Thus, when a voltage is applied to the ejection electrode 18, a part of the electric charge supplied to the ejection electrode 18 is injected into the ink Q to increase the conductivity of the ink Q in the vicinity of the ejection electrode 18. As a result, only when the voltage is applied to the ejection electrode 18, the ink Q becomes a state in which the ink droplets are remarkably easy to eject (the ejection property is enhanced).

Thus, while the ejection electrode 18 preferably contacts the ink Q, the present invention is not limited thereto. The ejection electrode 18 may also be disposed in a position where the ejection electrode 18 does not contact the ink Q, e.g., inside the ejection port substrate 16.

It should be noted that the ejection electrode 18 is not limited to the ring-like circular electrode, and thus various shapes can be utilized for the ejection electrode 18. A preferable example thereof is an enclosing electrode disposed so as to surround the ejection port 28 (a part thereof may be cut). The ejection electrode 18 is more preferably a nearly circular electrode and is much more preferably a circular electrode.

In this embodiment, the ejection electrode 18 is disposed on the lower surface of the first insulating layer 34*a*, but the position of the ejection electrode 18 is not especially limited. The ejection electrode 18 may be disposed within the ejection port substrate 16. Moreover, the position of the ejection electrode 18 is not limited to the periphery of the ejection port substrate 16. The ejection electrode 18 may also be disposed on the head substrate 12, within the head substrate 12, or the like.

Furthermore, while one ejection electrode 18 is disposed for every ejection portion, the present invention is not limited thereto. A multi-layer electrode structure may also be adopted in which ejection electrodes are disposed for every ejection portion.

The guard electrode 20 is formed on the upper surface of the first insulating layer 34*a*, and its surface is covered with the second insulating layer 34*b*. As shown in FIG. 2A, the guard electrode 20 is a sheet-like electrode which is made of a metallic plate and which is common to the ejection electrodes 18. Openings 36 are bored through the guard electrode 20 and correspond to the ejection electrodes 18 which are respectively formed on the peripheries of the ejection ports 28 two-dimensionally disposed. Each opening 36 has a diameter larger than that of each ejection electrode 18.

The guard electrode 20 shields against electric lines of force between the adjacent ejection electrodes 18 to suppress the electric field interference between the adjacent ejection electrodes 18. Thus, a predetermined voltage (including the grounding voltage, i.e., 0 V) is applied to the guard electrode 20. In the illustrated embodiment, the guard electrode 20 is grounded, and hence a voltage thereof is 0 V.

In the illustrated embodiment, preferably, the guard electrode 20 is formed in the layer different from that containing the ejection electrodes 18, and moreover, its whole surface is covered with the second insulating layer 34*b*.

The ink jet head 10 has the guard electrode 20, whereby the electric field interference between the adjacent ejection electrodes 18 can be suitably prevented, and the colorant particles of the ink Q can be prevented from being deposited to cause the discharge between the ejection electrodes 18 and the guard electrode 20.

Here, the guard electrode 20 needs to be provided so as to shield against the electric lines of force directed from other ejection ports 28 (hereinafter referred to as "other channels" for the sake of convenience) and the electric lines of force directed to the other ejection ports 28 while ensuring the electric lines of force acting on the corresponding ejection port 28 (hereinafter referred to as "own channel" for convenience) among the electric lines of force generated from the ejection electrodes 18.

If there is no guard electrode 20, the electric lines of force generated from the inner peripheral portion of the ejection electrode 18 converge into the inner side of the ejection electrode 18 to act on the own channel, thereby generating the necessary electric field. On the other hand, the electric lines of force generated from the outer peripheral portion of the ejection electrode 18 diverge to the outer side of the ejection electrode 18 to influence the other channels to cause the electric field interference.

If the above points are taken into consideration, the diameter of the opening 36 of the guard electrode 20, when the substrate plane is viewed from above, is preferably made larger than the internal diameter of the ejection electrode 18 of the own channel to avoid shielding against the electric lines of force directed to the own channel. Specifically, the end portion of the guard electrode 20 on the ejection port 28 side (hereinafter, an ejection port side end portion and an opposite side end portion of each member are referred to as "an inner edge portion" and "an outer edge portion", respectively) is preferably more spaced apart from the ejection port 28 than the inner edge portion of the ejection electrode 18 of the own channel. According to the studies made by the inventor of the present invention, the distance between the inner edge portion of the ejection electrode 18 and the inner edge portion of the guard electrode 20 is preferably equal to or larger than 10 μm.

In addition, for the efficient shielding against the electric lines of force directed to the other channels, the diameter of the opening 36 of the guard electrode 20, when the substrate plane is viewed from above, is preferably made smaller than the outer diameter of the ejection electrode 18 of the own channel. Specifically, the inner edge portion of the guard electrode 20 is preferably closer to the ejection port 28 than the outer edge portion of the ejection electrode 18 of the own channel. According to the studies made by the inventor of the present invention, the distance between the outer edge portion of the ejection electrode 18 and the inner edge portion of the guard electrode 20 is preferably equal to or larger than 5 μm, more preferably equal to or larger than 10 μm.

With the above construction, the stable ejection of the ink droplets from the ejection port 28 is ensured, variations in the ink adhering position due to the electric field interference between the adjacent channels can be suitably suppressed, and thus a high-quality image can be consistently recorded.

In the above embodiment, the ejection electrode 18 has been described as the circular electrode. However, when the ejection electrode 18 is not the circular electrode, an effective diameter such as an average diameter that can be substantially regarded as a diameter has to be taken into consideration in accordance with the shape of the ejection electrode 18. Alternatively, the guard electrode 20 may also be provided so that the shape of the opening 36 of the guard electrode 20 is made substantially similar to the inner peripheral shape or the outer peripheral shape of the ejection electrode 18, and in each peripheral position of the ejection electrode 18, the inner edge portion of the guard electrode 20 is more spaced apart from the ejection port 28 than the inner edge portion of the ejection electrode 18 of the own channel and is closer to the ejection port 28 than the outer edge portion thereof.

In the above embodiment, the guard electrode 20 is a sheet-like electrode, but the present invention is not limited thereto. Any electrode may be used as the guard electrode 20 as long as this electrode is provided so as to shield against the electric lines of force directed from the other channels among the ejection portions. For example, the guard electrode 20 may be provided in a mesh-like structure among the ejection portions. Alternatively, the guard electrode 20 may be provided not between the ejection portions which are so distant from one another as not to cause the electric field interference, but only between the ejection portions close to each other.

In this case as well, the guard electrode 20 may be formed so that its inner edge portion is more spaced apart from the ejection port 28 than the inner edge portion of the ejection electrode 18 of the own channel, and is closer to the ejection port 28 than the outer edge portion of the ejection electrode 18 of the own channel.

As described above, in FIG. 1A, the counter electrode 24 is disposed so as to face the surface of the ink jet head 10 from which the ink droplets R are to be ejected.

The counter electrode 24 is disposed so as to face the tip end portion 14*a* of the ink guide 14, and includes an electrode substrate 24*a* which is grounded and the insulating sheet 24*b* which is disposed on a lower surface of the electrode substrate 24*a* in FIG. 1A, that is, on a surface of the electrode substrate 24*a* on the side of the ink jet head 10.

The recording medium P is supported on the lower surface of the counter electrode 24 in FIG. 1A, that is, on the surface of the insulating sheet 24*b* by electrostatic attraction for example. The counter electrode 24 (the insulating sheet 24*b*) functions as a platen for the recording medium P.

At least during recording, the recording medium P held on the insulating sheet 24*b* of the counter electrode 24 is charged by the charge unit 26 to a predetermined negative high voltage opposite in polarity to that of the drive voltage (for example, the pulse voltage) applied to the ejection electrode 18, e.g., −1.5 kV.

As a result, the recording medium P is charged negative to be biased to the negative high voltage to function as the substantial counter electrode to the ejection electrode 18, and is electrostatically attracted to the insulating sheet 24*b* of the counter electrode 24.

The charge unit 26 includes a scorotron charger 26*a* for charging the recording medium P to a negative high voltage, and a bias voltage source 26*b* for supplying a negative high voltage to the scorotron charger 26*a*. Note that the charge means of the charge unit 26 used in the present invention is not limited to the scorotron charger 26*a*, and hence various discharge means such as a corotron charger, a solid-state charger and an electrostatic discharge needle can be used.

In addition, in the illustrated embodiment, the counter electrode 24 includes the electrode substrate 24*a* and the insulating sheet 24*b*, and the charge unit 26 is used to charge the recording medium P to a negative high voltage to apply a bias voltage to the medium P so that the medium P functions as the counter electrode and is electrostatically attracted to the surface of the insulating sheet 24*b*. However, this is not the sole case of the present invention and another configuration is also possible in which the counter electrode 24 is constituted only by the electrode substrate 24*a*, and the counter electrode 24 (the electrode substrate 24*a*) is connected to a bias voltage source for supplying a negative high voltage and is always biased to the negative high voltage so that the recording medium P is electrostatically attracted to the surface of the counter electrode 24.

Further, the electrostatic attraction of the recording medium P to the counter electrode 24, the charge of the recording medium P to the negative high voltage, and the application of the negative high bias voltage to the counter electrode 24 may be performed using separate negative high voltage sources. Also, the support of the recording medium P by the counter electrode 24 is not limited to the utilization of the electrostatic attraction of the recording medium P, and hence any other supporting method or supporting means may be used for the support of the recording medium P by the counter electrode 24.

Hereinafter, the present invention will be described in greater detail by reference to the ejection operation for the ink droplets R in the ink jet head 10.

As illustrated in FIG. 1A, upon recording, the ink Q containing colorant particles charged in the same polarity as that of the voltage to be applied to the ejection electrode 18, for example positively charged colorant particles is circulated by the ink circulating mechanism including a pump (not shown) in a direction shown by an arrow (from the right to the left in FIG. 1A) in the main ink flow path 30 of the ink jet head 10.

On the other hand, the recording medium P on which an image is to be recorded is charged to have the polarity opposite to that of the colorant particles, that is, a negative high voltage (for example, −1500 V) by the charge unit 26. While being charged to the bias voltage, the recording medium P is electrostatically attracted to the counter electrode 24.

In this state, the recording medium P (counter electrode 24) and the ink jet head 10 are moved relatively while the signal voltage source 33 applies a drive voltage (pulse voltage) to each ejection electrode 18 in accordance with supplied image data. Ejection ON/OFF is controlled depending on whether or not the drive voltage is applied, whereby the ink droplets R are modulated in accordance with the image data and ejected to record an image on the recording medium P.

Here, when the drive voltage is not applied to the ejection electrode 18 (or the applied voltage is at a low voltage level), i.e., in a state where the bias voltage is only applied, Coulomb attraction between the bias voltage and the charges of the colorant particles (charged particles) of the ink Q, Coulomb repulsion among the colorant particles, viscosity of the carrier liquid, surface tension, and dielectric polarization force, and the like act on the ink Q, and these factors operate in conjunction with one another to move the colorant particles and the carrier liquid. Thus, the balance is kept in a meniscus shape as conceptually shown in FIG. 1A in which the ink Q slightly rises from the ejection port 28.

In addition, the Coulomb attraction and the like allow the colorant particles to move toward the recording medium P charged to the bias voltage through a so-called electrophoresis process. That is, the ink Q is concentrated at the meniscus in the ejection port 28.

From this state, the drive voltage is applied to the ejection electrode 18. As a result, the drive voltage is superposed on the bias voltage, and hence the motion occurs in which the previous conjunction motion operates in conjunction with the superposition of the drive voltage. Thus, the colorant particles and the carrier liquid are attracted toward the bias voltage side (the counter electrode side), i.e., the recording medium P side by the electrostatic force. The meniscus grows to form a nearly conical ink liquid column, i.e., the so-called Taylor cone from the tip portion of the meniscus. In addition, similarly to the foregoing, the colorant particles are moved to the meniscus surface through the electrophoresis process so that the ink Q at the meniscus is concentrated and has a large number of colorant particles at a nearly uniform high concentration.

When a finite period of time further elapses after the start of the application of the drive voltage, the balance mainly between the Coulomb attraction acting on the colorant particles and the surface tension of the carrier liquid is broken at the tip portion of the meniscus having the high electric field strength applied thereto due to the movement of the colorant particles or the like. As a result, the meniscus abruptly grows to form a slender ink liquid column called the thread having about several μm to several tens of μm in diameter.

When a finite period of time further elapses, the thread grows, and is divided into small portions due to the interaction resulting from the growth of the thread, the vibrations generated due to the Rayleigh/Weber instability, the ununiformity in distribution of the colorant particles within the meniscus, the ununiformity in distribution of the electrostatic field applied to the meniscus, and the like. The divided thread is then ejected and flown in the form of the ink droplets R and is attracted by the bias voltage as well to adhere to the recording medium P. The growth of the thread and its division, and moreover the movement of the colorant particles to the meniscus and/or the thread are continuously generated while the drive voltage is applied to the control electrode.

After the end of the application of the drive voltage (ejection is OFF), the meniscus returns to the above-mentioned state where only the bias voltage is applied.

Here, as described above, in the ink jet head 10 for ejecting the ink droplets from the ejection ports, it is required for the ink jet heads using other systems as well as for the electrostatic ink jet head that the ink meniscus is stably formed in order to stabilize the ejection of the ink droplets, and moreover the property of holding the ink meniscus is enhanced in order to prevent the ink from leaking from the ejection ports.

As a result of intensive studies about this point, the inventor of the present invention has found out that irrespective of the system used in the ink jet head, the property of holding the ink meniscus changes depending on the shape of the ejection port substrate at a point at which the surface of the ink meniscus contacts the ejection port substrate (this point is hereinafter referred to as "a contact point").

Furthermore, the inventor of the present invention has also found out that by increasing the angle θ at the contact point between the ejection port substrate and the ink meniscus surface, the property of holding the ink meniscus can be enhanced and thus the ink meniscus can be stably formed. Here, the angle θ at the contact point means an angle between the ink meniscus surface at the contact point and the surface of the ejection port substrate 16 outside the contact point (the hypotenuse 38*d* of the projection 38 in FIG. 1B).

Here, in this specification, a portion in which the surface of the projection or a protrusion to be described later having an inclination becoming nearer the recording medium P in a position nearer the ejection port contacts the surface of the ink meniscus is defined as an uppermost surface. In addition, the surface which passes through the end portion, on the recording medium P side, of the surface of the projection or a protrusion to be described later whose inclination becomes nearer the recording medium P in a position nearer the ejection port, and which is parallel with the ejection direction is defined as a reference surface.

In the ink jet head 10 of the illustrated embodiment, as described above, the projection 38 is formed on the upper surface of the ejection port substrate 16 (on the recording medium P side) so as to surround the ejection port 28. At this time, the cross-sectional shape of the projection 38 has the tip portion 38*a* on a line extending from the periphery of the ejection port 28 toward the recording medium P.

Since the projection 38 is formed on the periphery of the ejection port 28, the tip portion 38*a* of the projection 38 becomes the contact point. Here, the tip portion 38*a* of the projection 38 is sharp. Specifically, the angle between the surface (reference surface) which passes through the end portion of the upper surface of the projection 38 on the recording medium P side, and which is parallel with the ejection direction, and the portion (uppermost surface) formed by the surface of the projection 38 having the inclination becoming nearer the recording medium P in a position nearer the ejection port, and the surface of the ink meniscus, i.e., the angle Φ between the side surface (the opposite side 38*c*) of the projection 38 and the upper surface (the hypotenuse 38*d*) of the projection 38 is an acute angle.

Figure 8:
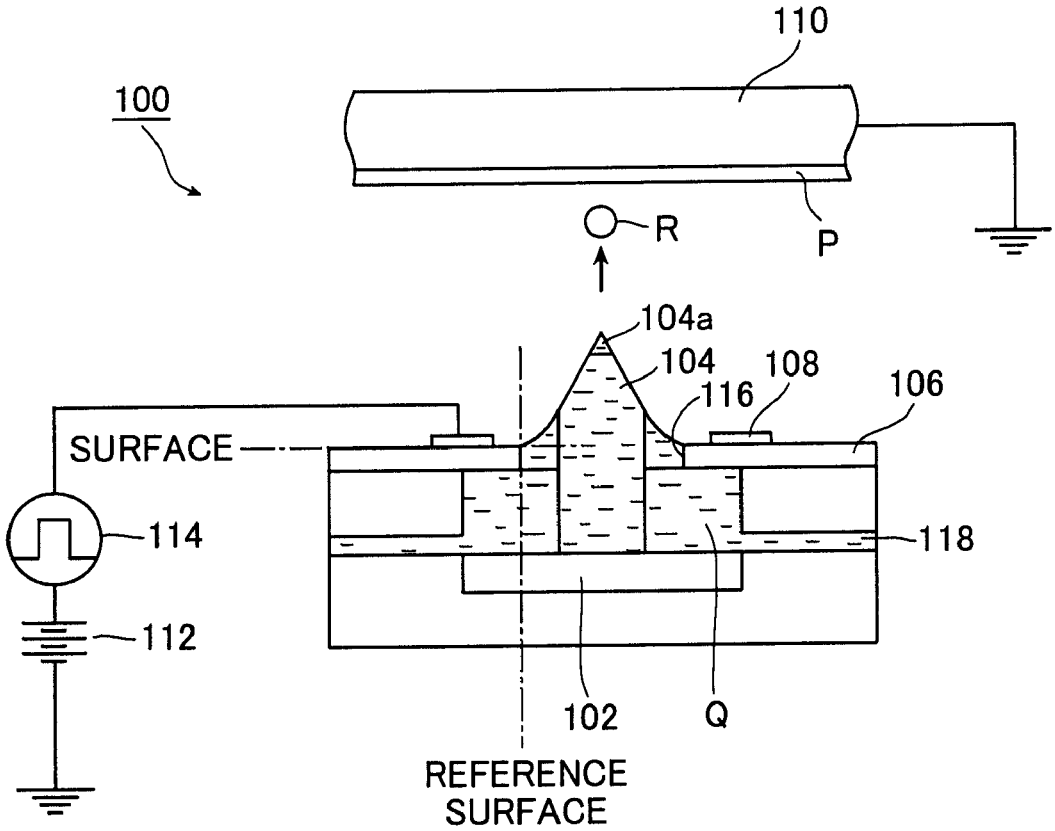
FIG. 8 PRIOR ART
FIG. 8 is a schematic cross-sectional view of a conventional ink jet head.

As a result, the angle θ at the contact point (the tip portion 38*a*) between the upper surface 38*b* and the surface of the ink meniscus becomes larger than the case where the meniscus is formed in the ejection port bored through the plate-like ejection port substrate of the conventional ink jet head, i.e., the case where as shown in FIG. 8 in which the meniscus is formed in the ejection port 116 in which the angle between the surface of the ejection port substrate 106 on the recording medium P side and the surface (reference surface) passing through an end portion of the ejection port substrate 106 on the ejection port 116 side and being parallel with the ejection direction is a right angle.

The angle between the uppermost surface and the reference surface is made acute, whereby the angle between the uppermost surface and the surface of the ink meniscus becomes larger, and hence the property of holding the ink meniscus in the ejection port is enhanced. Moreover, since the angle Φ of the tip portion of the projection is also an acute angle, the property of holding the ink meniscus in the ejection port is further enhanced. As a result, the ink meniscus is stably formed, whereby the ejection responsivity to the drive voltage becomes constant, the ejection of the ink droplets is stabilized and hence a high-quality image can be formed.

Figure 4:
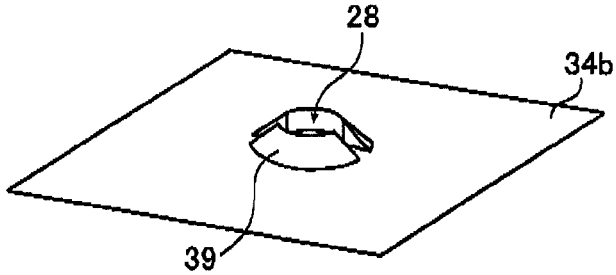
FIG. 4 is a perspective view showing another example of the shape of the projection.

While in an example shown in FIG. 3, the projection 38 is provided so as to wholly surround the ejection port 28, the present invention is not limited thereto. For example, as shown in FIG. 4, a projection 39 having a shape in which portions having a predetermined width are removed on an ink inflow side and an ink outflow side of the ejection port 28 may also be used.

The projection is provided in at least a part of the circumference of the ejection port, whereby the property of holding the ink meniscus can be enhanced. Here, the projection having a size equal to or larger than the width of the surface of the ink guide parallel with an ink flow direction is preferably provided in the portion of the ejection port orthogonally intersecting the ink flow direction, and is more preferably provided throughout the entire periphery of the ejection port.

In addition, while the upper surface 38*d* of the projection 38 of this embodiment forms a straight line in cross section, the present invention is not limited thereto. Alternatively, the upper surface 38*d* of the projection 38 may be curved. Hence, when the upper surface 38*d* of the projection 38 is curved, an end portion of the upper surface of the projection on the recording medium P side becomes the uppermost surface. Thus, the angle between the tangent of the uppermost surface and the reference surface has to be an acute angle.

In addition, the surface (the upper surface 38*d* in this embodiment) of the projection outside the contact point with the surface of the ink meniscus, and the surface of the ejection port substrate 16 preferably have ink repellency. The ink repellency processing is carried out on the outer portion of the contact point between the meniscus and the ejection port 28, whereby the property of holding the ink meniscus is further enhanced, and hence the ink droplets can be stably ejected.

Here, the ink repellency means water repellency in the case of aqueous ink, and oil repellency in the case of oily ink.

Examples of the method for imparting the ink repellency to the surface of the projection outside the contact point with the surface of the ink meniscus and the surface of the ejection port substrate include a method in which ink repellency processing is performed on the ejection port substrate and the inclined surface of the projection, and a method in which an ink-repellent material such as an ink-repellent film is stuck on or attached to the ejection port substrate and the inclined surface of the projection.

In addition, the height h of the projection 38 from the upper surface of the second insulating layer 34*b* to the tip portion 38*a* of the projection 38 is preferably in a range of 10 μm to 500 μm, and more preferably in a range of 10 μm to 200 μm, and much more preferably in a range of 10 μm to 100 μm.

When the height h is equal to or larger than 10 μm, the property of holding the ink meniscus can be enhanced, and when the height h is equal to or smaller than 500 μm, the length of the ejection port 28 can be reduced. Thus, the resistance between the ink Q and the inner wall of the ejection port 28 is reduced, the ejection responsivity of the ink droplets is enhanced, and the ejection of the ink droplets can follow up to an ejection frequency of 5 kHz. Here, the ejection frequency means a frequency at which the ink droplets are ejected.

In addition, when the height h is equal to or smaller than 300 μm, the resistance between the ink Q and the inner wall of the ejection port 28 can be further reduced and the ejection responsivity can be further enhanced Thus, the ejection of the ink droplets can follow up to the ejection frequency of 10 kHz.

Moreover, when the height h is equal to or smaller than 100 μm, the resistance between the ink Q and the inner wall of the ejection port 28 can be further reduced and the ejection responsivity can be further enhanced. Thus, the ejection of the ink droplets can follow up to the ejection frequency of 15 kHz.

Figure 5A:
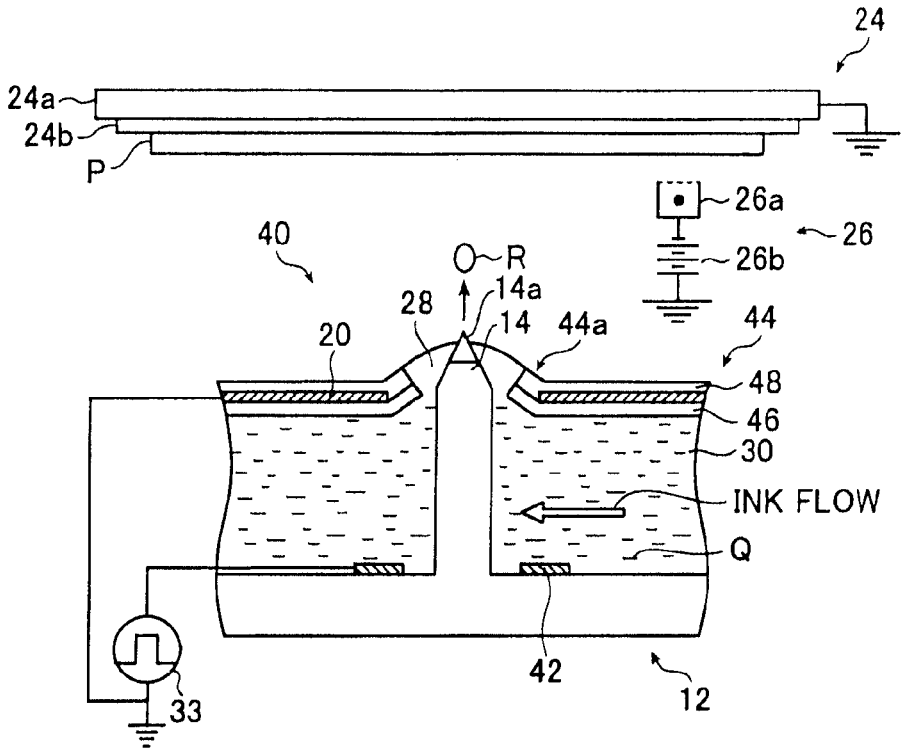
FIG. 5A is a schematic cross-sectional view of the ink jet head according to another embodiment of the present invention.
Figure 5B:
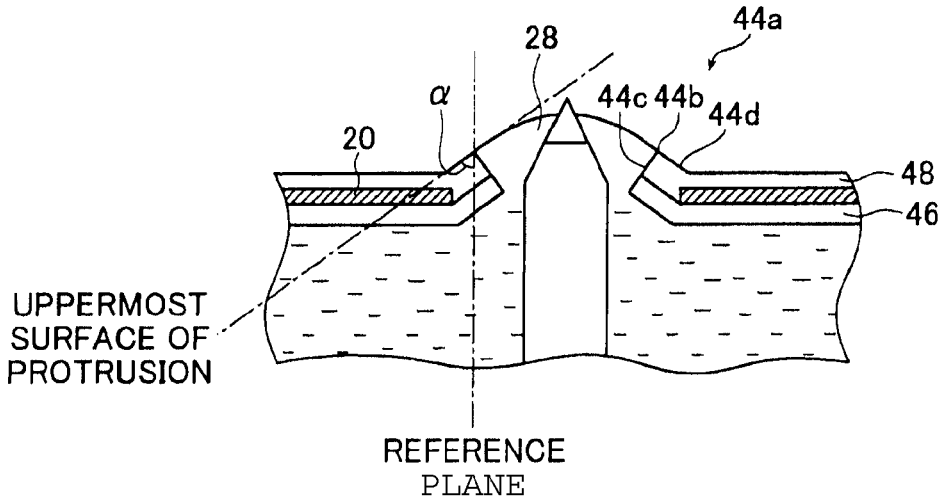
FIG. 5B is an enlarged view showing the periphery of an ejection port of the ink jet head shown in FIG. 5A.

FIGS. 5A and 5B show conceptual views each showing another embodiment of the ink jet head of the present invention.

Note that an ink jet head 40 shown in FIGS. 5A and 5B is different from the ink jet head 10 shown in FIGS. 1A and 1B only in construction of the ejection port substrate and position of the ejection electrodes. Thus, the same members as those in the ink jet head 10 are designated with the same reference numerals and their detailed description is omitted here. A different point will hereinafter be mainly described.

In an ejection port substrate 44 of this embodiment, a guard electrode 20 is formed on an insulating substrate 46 and the guard electrode 20 is covered with an insulating layer 48 and ejection ports 28 are bored through the ejection port substrate 44. The peripheral portion of each ejection port in the ejection port substrate 44 has a shape in which the peripheral portion extends upwardly to be closer to a counter electrode as the distance from the ejection port 28 is decreased. Hereinafter, a protruded portion of the ejection port substrate 44 is referred to as a protrusion 44*a*.

The protrusion 44*a* has a tip portion 44*b* on the recording medium P side. Here, the tip portion 44*b* is a corner portion formed by a side face 44*c* of the protrusion 44*a* as a part of the ejection port 28, and an upper surface 44*d* of the protrusion 44*a* which slopes down as the distance from the center of the ejection port 28 increases, whereby the distance between the recording medium P and the upper surface 44*d* is increased. The angle α between the surface (reference surface) which passes through the tip portion 44*b* and is parallel with the ejection direction, and the upper surface 44*d* of the protrusion 44*a* (the uppermost surface of the protrusion 44*a*) is an acute angle.

In this embodiment as well, the tip portion 44*b* becomes a contact point between the protrusion 44*a* and the surface of the ink meniscus. As described above, the angle α between the reference surface and the uppermost surface of the protrusion 44*a* is an acute angle. Hence, the angle between the surface of the ink meniscus and the uppermost surface of the protrusion 44*a* becomes larger than that in the conventional ink jet head, and thus the property of holding the ink meniscus is enhanced.

Even in the case where the protrusion is formed by processing the ejection port substrate, the property of holding the ink meniscus can also be enhanced as in the embodiment shown in FIGS. 1A and 1B.

The protrusion 44*a* as in this embodiment can be formed for example by embossing a plate-like substrate.

In addition, in the present invention, the shape only has to be determined such that the angle formed at the contact point between the surface of the ink meniscus and the uppermost surface of the projection or the protrusion is large. Thus, in the projection or the protrusion, the surface constituting the ejection port may incline as in this embodiment as long as the angle between the uppermost surface and the reference surface is an acute angle. In addition, the projection or the protrusion may have a surface perpendicular to the ejection direction, for example, the tip portion may have a given width, if the formation of the ink meniscus on the ink guide side as viewed from the contact point cannot be impeded.

While in this embodiment, the ejection electrode 42 is disposed on the head substrate 12, the ejection electrode 42 of this embodiment may be disposed on a lower surface of the ejection port substrate 44, inside the ejection port substrate 44, or inside the head substrate 12 as in the ink jet head 10 shown in FIGS. 1A and 1B. In addition, in this embodiment, one ejection electrode 42 is disposed in every ejection port 28. However, it is to be understood that even when the ejection electrode 42 is disposed on the head substrate 12, a multilayer electrode structure may also be adopted in which ejection electrodes are disposed in every ejection portion.

Figure 6A:
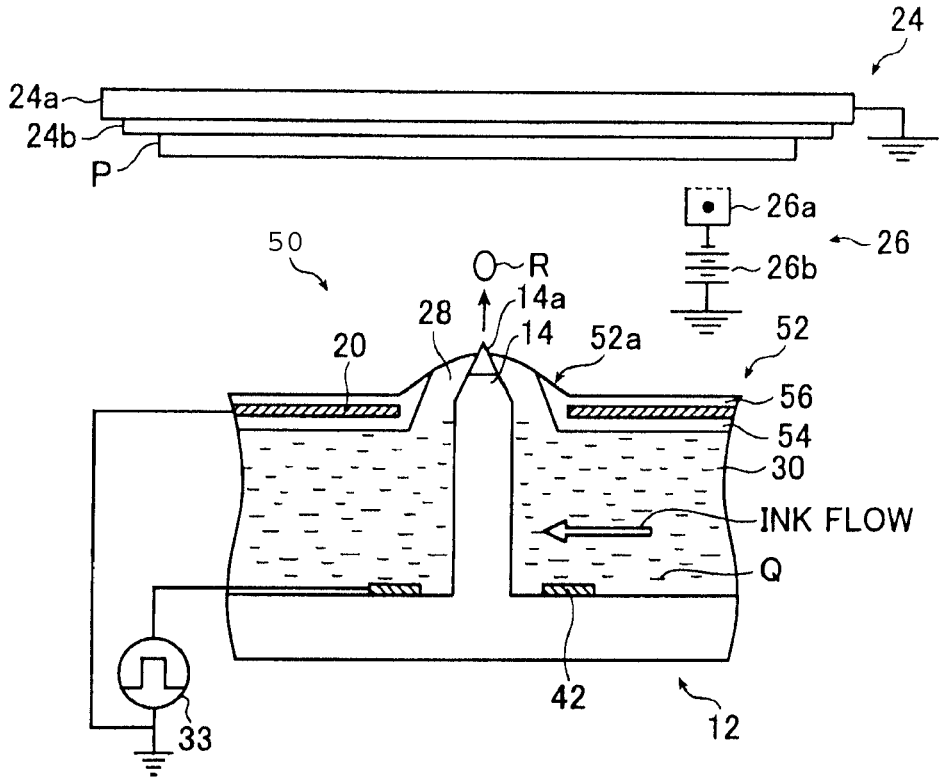
FIG. 6A is a schematic cross-sectional view of the ink jet head according to still another embodiment of the present invention.
Figure 6B:
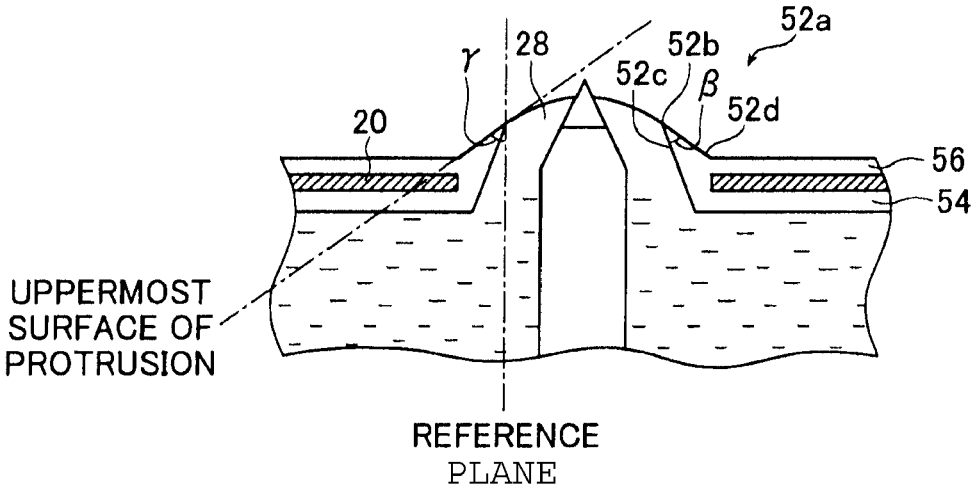
FIG. 6B is an enlarged view showing the periphery of an ejection port of the ink jet head shown in FIG. 6A.

FIGS. 6A and 6B are conceptual views each showing still another embodiment of the ink jet head of the present invention.

An ink jet head 50 shown in FIGS. 6A and 6B is different only in shape of the ejection port substrate from the ink jet head 40 shown in FIGS. 5A and 5B. Thus, the same members as those in the ink jet head 40 shown in FIGS. 5A and 5B are designated with the same reference numerals and their detailed description is omitted here. Hereinafter, a different point will be mainly described.

In an ejection port substrate 52, a guard electrode 20 is disposed on an insulating substrate 54 and the guard electrode 20 is covered with an insulating layer 56 and ejection ports are bored through the ejection port substrate 52. In addition, the peripheral portion of each ejection port 28 in the ejection port substrate 52 has a protrusion 52*a* which protrudes toward the counter electrode as the distance from the ejection port 28 is decreased.

The protrusion 52*a* has a tip portion 52*b* on the record medium P side. Here, the tip portion 52*b* is a corner portion formed by a lower surface 52*c* of the protrusion 52*a* which forms the ejection port 28 and faces the ink flow path 30 side, and an upper surface 52*d* of the protrusion 52*a* which slopes down as the distance from the center of the ejection port 28 increases, whereby the distance between the recording medium P and the upper surface 52*d* is increased. Thus, the tip portion 52*b* forms a sharply pointed portion. That is, the protrusion 52*a* of this embodiment has a shape in which both the upper surface 52*d* and the lower surface 52*c* extend upwardly toward the recording medium P side and also the ejection port substrate 52 becomes thinner toward the center of the ejection port 28, and thus the upper surface 52*d* and the lower surface 52*c* of the ejection port substrate 16 (the protrusion 52*b*) are joined to each other in the tip portion 52*d*.

In such a shape as well, the angle γ between the surface (reference surface) which passes through the tip portion 52*b* and is parallel with the ejection direction, and the upper surface 52*d* (uppermost surface) can be an acute angle. Hence, the angle in the tip portion 52*d* between the upper surface 52*d* and the ink meniscus surface can be made larger, and thus the property of holding the ink meniscus can be enhanced. Moreover, since the angle in the tip portion 52*b* of the protrusion 52*a*, i.e., the angle β between the upper surface 52*d* and the lower surface 52*c* becomes an acute angle, the property of holding the ink meniscus in the ejection port 28 is further enhanced.

As described above, the ink jet head of the present invention has the shape in which the portion convexly protruding along the ejection direction is provided in at least a part of the periphery of the ejection port by projecting the periphery of the ejection port, by providing the projection on the periphery of the ejection portion, or by integrally forming the projection on the periphery of the ejection portion, whereby the ink meniscus holding property can be enhanced.

In particular, as described above, in the ink jet head of the present invention, at least a part of the ejection port substrate serving as the contact point between the ejection port substrate and the ink meniscus surface is formed into the shape in which the tip portion of the projection or the protrusion is sharpened, i.e., into the shape in which the angle between the uppermost surface of the projection or the protrusion, and the reference surface is an acute angle. Therefore, the angle between the uppermost surface and the meniscus surface becomes large, and hence the property of holding the ink meniscus can be further enhanced.

Moreover, the shape in which the tip portion of the projection or the protrusion has an acute angle, i.e., the angle of the projection or the protrusion in the contact point between the projection or the protrusion, and the ink meniscus surface becomes an acute angle, enables further enhancement in the property of holding the ink meniscus.

It should be noted that as long as at least a part of the ejection port substrate has a portion convexly protruding along the ejection direction of the ink droplets, various constructions can be utilized for other portions. For example, the present invention can be also applied to an inkjet head including no ink guide.

The ink Q (ink composition) which is ejected by the ink jet head 10 is obtained by dispersing colorant particles (charged fine particles which contain colorants) in a carrier liquid.

The carrier liquid is preferably a dielectric liquid (non-aqueous solvent) having a high electrical resistivity (equal to or larger than $10^9$ Ω·cm, and more preferably equal to or larger than $10^{10}$ Ω·cm). If the electrical resistivity of the carrier liquid is low, the concentration of the colorant particles does not occur since the carrier liquid receives the injection of the electric charges and is charged due to a drive voltage applied to the ejection electrodes. In addition, since there is also anxiety that the carrier liquid having a low electrical resistivity causes the electrical conduction between the adjacent ejection portions, the carrier liquid having a low electrical resistivity is unsuitable for the present invention.

The relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby the electric field effectively acts on the colorant particles contained in the carrier liquid to facilitate the electrophoresis of the colorant particles.

Note that the upper limit of the specific electrical resistance of the carrier liquid is desirably about $10^{16}$ Ω·cm, and the lower limit of the relative permittivity is desirably about 1.9. The reason why the electrical resistance of the carrier liquid preferably falls within the above-mentioned range is that if the electrical resistance becomes low, then the ejection of the ink under a low electric field becomes worse. Also, the reason why the relative permittivity preferably falls within the above-mentioned range is that if the relative permittivity becomes high, then the electric field is relaxed due to the polarization of the solvent, and as a result the color of dots formed under this condition becomes light, or the bleeding occurs.

Preferred examples of the dielectric liquid used as the carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent, (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such colorant particles dispersed in the carrier liquid, colorants themselves may be dispersed as the colorant particles into the carrier liquid, but dispersion resin particles are preferably contained for enhancement of fixing property. In the case where the dispersion resin particles are contained in the carrier liquid, in general, there is adopted a method in which pigments are covered with the resin material of the dispersion resin particles to obtain particles covered with the resin, or the dispersion resin particles are colored with dyes to obtain the colored particles.

As the colorants, pigments and dyes conventionally used in ink compositions for ink jet recording, (oily) ink compositions for printing, or liquid developers for electrostatic photography may be used.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazine pigments, threne pigments, perylene pigments, perinone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinoneimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

Further, examples of dispersion resin particles include rosins, rosin-modified phenol resin, alkyd resin, a (meta)acryl polymer, polyurethane, polyester, polyamide, polyethylene, polybutadiene, polystyrene, polyvinyl acetate, acetal-modified polyvinyl alcohol, and polycarbonate.

Of those, from the viewpoint of ease for particle formation, a polymer having a weight average molecular weight in a range of 2,000 to 1,000,000 and a polydispersity (weight average molecular weight/number average molecular weight) in a range of 1.0 to 5.0 is preferred. Moreover, from the viewpoint of ease for the fixation, a polymer in which one of a softening point, a glass transition point, and a melting point is in a range of 40° C. to 120° C. is preferred.

In the ink Q, the content of colorant particles (total content of colorant particles and dispersion resin particles) preferably falls within a range of 0.5 to 30.0 wt % for the overall ink, more preferably falls within a range of 1.5 to 25.0 wt %, and much more preferably falls within a range of 3.0 to 20.0 wt %. If the content of colorant particles decreases, the following problems become easy to arise. The density of the printed image is insufficient, the affinity between the ink Q and the surface of the recording medium P becomes difficult to obtain to prevent the image firmly stuck to the surface of the recording medium P from being obtained, and so forth. On the other hand, if the content of colorant particles increases, problems occur in that the uniform dispersion liquid becomes difficult to obtain, the clogging of the ink Q is easy to occur in the ink jet head or the like to make it difficult to obtain the stable ink ejection, and so forth.

In addition, the average particle diameter of the colorant particles dispersed in the carrier liquid preferably falls within a range of 0.1 to 5.0 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA LTD.).

After the colorant particles are dispersed in the carrier liquid and optionally a dispersing agent, a charging control agent is added to the resultant carrier liquid to charge the colorant particles, and the charged colorant particles are dispersed in the resultant liquid to thereby produce the ink Q. Note that in dispersing the colorant particles in the carrier liquid, a dispersion medium may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16(No. 2), p. 44, 1977.

Note that the colorant particles may be positively or negatively charged as long as the charged colorant particles are identical in polarity to the drive voltages applied to ejection electrodes 18.

In addition, the charging amount of colorant particles is preferably in a range of 5 to 200 μC/g, more preferably in a range of 10 to 150 μC/g, and much more preferably in a range of 15 to 100 μC/g.

In addition, the electrical resistance of the dielectric solvent may be changed by adding the charging control agent in some cases. Thus, the distribution factor P defined below is preferably equal to or larger than 50%, more preferably equal to or larger than 60%, and much more preferably equal to or larger than 70%.

$$P=100\times(\sigma1-\sigma2)/\sigma1$$

where σ1 is an electric conductivity of the ink Q, and σ2 is an electric conductivity of a supernatant liquid which is obtained by inspecting the ink Q with a centrifugal separator. Those electric conductivities were obtained by measuring the electric conductivities of the ink Q and the supernatant liquid under a condition of an applied voltage of 5 V and a frequency of 1 kHz using an LCR meter of an AG-4311 type (manufactured by ANDO ELECTRIC CO., LTD.) and electrode for liquid of an LP-05 type (manufactured by KAWAGUCHI ELECTRIC WORKS, CO., LTD.). In addition, the centrifugation was carried out for 30 minutes under a condition of a rotational speed of 14,500 rpm and a temperature of 23° C. using a miniature high speed cooling centrifugal machine of an SRX-201 type (manufactured by TOMY SEIKO CO., LTD.).

The ink Q as described above is used, which results in that the colorant particles are likely to migrate and hence the colorant particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the ejection electrodes are not excessively high, and also there is no anxiety to cause the electrical conduction between the adjacent ejection electrodes.

In addition, the surface tension of the ink Q is preferably in a range of 15 to 50 mN/m, more preferably in a range of 15.5 to 45.0 mN/m, and much more preferably in a range of 16 to 40 mN/m. The surface tension is set in this range, resulting in that the applied voltages to the ejection electrodes are not excessively high, and also the ink does not leak or spread to the periphery of the head to contaminate the head.

Moreover, the viscosity of the ink Q is preferably in a range of 0.5 to 5.0 mPa·sec, more preferably in a range of 0.6 to 3.0 mPa·sec, and much more preferably in a range of 0.7 to 2.0 mPa·sec.

The ink Q can be prepared for example by dispersing colorant particles into a carrier liquid to form particles and adding a charging control agent to the dispersion medium to allow the colorant particles to be charged. The following methods are given as the specific methods.

(1) A method including: previously mixing (kneading) a colorant and/or dispersion resin particles; dispersing the resultant mixture into a carrier liquid using a dispersing agent when necessary; and adding the charging control agent thereto.

(2) A method including: adding a colorant and/or dispersion resin particles and a dispersing agent into a carrier liquid at the same time for dispersion; and adding the charging control agent thereto.

(3) A method including adding a colorant and the charging control agent and/or the dispersion resin particles and the dispersing agent into a carrier liquid at the same time for dispersion.

Figure 7A:
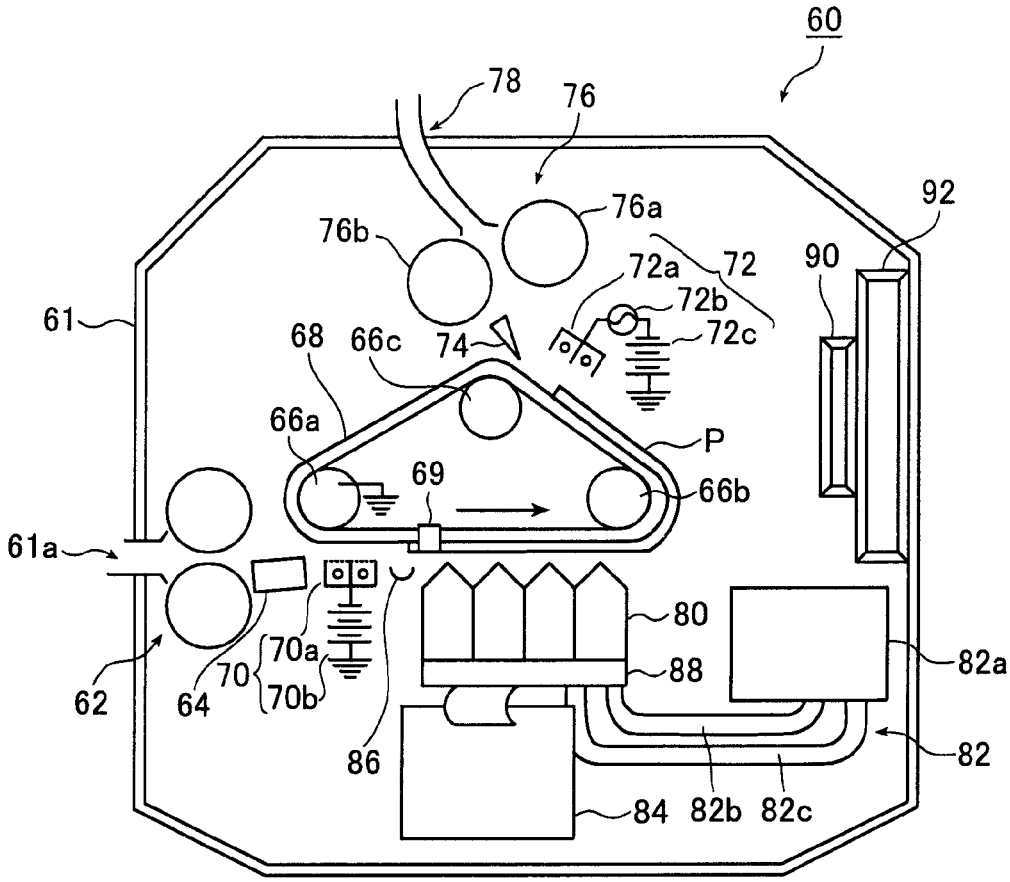
FIG. 7A is a schematic cross-sectional view of an ink jet recording apparatus according to an embodiment of the present invention.

FIG. 7A is a conceptual diagram of an embodiment of an ink jet recording apparatus of the present invention which utilizes the ink jet head of the present invention.

An ink jet recording apparatus 60 (hereinafter, referred to as printer 60) illustrated in FIG. 7A is an apparatus for performing four-color one-side printing on the recording medium P. The printer 60 includes conveyor means for the recording medium P, image recording means, and solvent collecting means, all of which are accommodated in a casing 61.

The conveyor means includes a feed roller pair 62, a guide 64, rollers 66 (66*a*, 66*b*, and 66*c*), a conveyor belt 68, conveyor belt position detecting means 69, electrostatic attraction means 70, discharge means 72, peeling means 74, fixation/conveyance means 76, and a guide 78. The image recording means includes a head unit 80, an ink circulating system 82, a head driver 84 and recording medium position detecting means 46. The solvent collecting means includes a discharge fan 90, and a solvent collecting device 92.

In the conveyor means for the recording medium P, the feed roller pair 62 is a conveyance roller pair disposed in the vicinity of a feeding port 61*a* provided on a side surface of the casing 61. The feed roller pair 62 feeds the recording medium P fed from a paper cassette (not shown) to the conveyor belt 68 (a portion supported by the roller 66*a* in FIG. 7A). The guide 64 is disposed between the feed roller pair 62 and the roller 66*a* for supporting the conveyor belt 68 and guides the recording medium P fed by the feed roller pair 62 to the conveyor belt 68.

Foreign matter removal means for removing foreign matter such as dust or paper powder adhered to the recording medium P is preferably disposed in the vicinity of the feed roller pair 62.

As the foreign matter removal means, one or more of known methods including non-contact removal methods such as suction removal, blowing removal and electrostatic removal, and contact removal methods such as removal using a blush, a roller, etc., may be used in combination. It is also possible that the feed roller pair 62 is composed of a slightly adhesive roller, a cleaner is prepared for the feed roller pair 62, and foreign matter such as dust or paper powder is removed when the feed roller pair 62 feeds the recording medium P.

The conveyor belt 68 is an endless belt extended over the three rollers 66 (66*a*, 66*b*, and 66*c*). At least one of the rollers 66*a*, 66*b*, and 66*c* is connected to a drive source (not shown) to rotate the conveyor belt 68.

At the time of image recording by the head unit 80, the conveyor belt 68 functions as scanning conveyor means for the recording medium P and also as a platen for holding the recording medium P. After the end of image recording, the conveyor belt 68 further conveys the recording medium P to the fixation/conveyance means 76. Therefore, the conveyor belt 68 is preferably made of a material which is excellent in dimension stability and has durability. The conveyor belt 68 is for example made of a metal, a polyimide resin, a fluororesin, another resin, or a complex thereof.

In the illustrated embodiment, the recording medium P is held on the conveyor belt 68 under electrostatic attraction. In correspondence with this, the conveyor belt 68 has insulating properties on a side on which the recording medium P is held (front face), and conductive properties on the other side on which the belt 68 contacts the rollers 66 (rear face). Further, in the illustrated embodiment, the roller 66*a* is a conductive roller, and the rear face of the conveyor belt 68 is grounded via the roller 66*a*.

In other words, the conveyor belt 68 also functions as the counter electrode 24 including the electrode substrate 24*a* and the insulating sheet 24*b* shown in FIG. 1A when the conveyor belt 68 holds the recording medium P.

A belt having a metal layer and an insulating material layer manufactured by a variety of methods, such as a metal belt coated with a resin material, for example, fluororesin on the front face, a belt obtained by bonding a resin sheet to a metal belt with an adhesive or the like, and a belt obtained by vapor-depositing a metal on the rear face of a belt made of the above-mentioned resin may be used as the conveyor belt 68.

The conveyor belt 68 preferably has the flat front face contacting the recording medium P, whereby satisfactory attraction properties of the recording medium P can be obtained.

Meandering of the conveyor belt 68 is preferably suppressed by a known method. An example of a meandering suppression method is that the roller 66*c* is composed of a tension roller, a shaft of the roller 66*c* is inclined with respect to shafts of the rollers 66*a* and 66*b* in response to an output of the conveyor belt position detecting means 69, that is, a position of the conveyor belt 68 detected in a width direction, thereby changing a tension at both ends of the conveyor belt in the width direction to suppress the meandering. The rollers 66 may have a taper shape, a crown shape, or another shape to suppress the meandering.

The conveyor belt position detecting means 69 suppresses the meandering of the conveyor belt etc. in the above manner and detects the position of the conveyor belt 68 in the width direction to regulate the recording medium P to situate at a predetermined position in the scanning/conveyance direction at the time of image recording. Known detecting means such as a photo sensor may be used.

The electrostatic attraction means 70 charges the recording medium P to a predetermined bias voltage with respect to the head unit 80 (ink jet head of the present invention), and charges the recording medium P to have a predetermined potential such that the recording medium P is attracted to and held on the conveyor belt 68 under an electrostatic force.

In the illustrated embodiment, the electrostatic attraction means 70 includes a scorotron charger 70*a* for charging the recording medium P and a negative high voltage power source 70*b* connected to the scorotron charger 70*a*. While being conveyed by the feed roller pair 62 and the conveyor belt 68, the recording medium P is charged to a negative bias voltage by the scorotron charger 70*a* connected to the negative high voltage power source 70*b* and attracted to the insulating layer of the conveyor belt 68.

Note that the conveying speed of the conveyor belt 68 when charging the recording medium P may be in a range where the charging is performed with stability, so the speed may be the same as, or different from, the conveying speed at the time of image recording. Also, the electrostatic attraction means may act on the same recording medium P several times by circulating the recording medium P several times on the conveyor belt 68 for uniform charging.

In the illustrated embodiment, the electrostatic attraction and the charging for the recording medium P are performed in the electrostatic attraction means 70, but the electrostatic attraction means and the charging means may be provided separately.

The electrostatic attraction means is not limited to the scorotron charger 70*a* of the illustrated embodiment; a corotron charger, a solid-state charger, an electrostatic discharge needle, and various means and methods can be employed. As will be described in detail later, at least one of the rollers 66 is composed of a conductive roller, or a conductive platen is disposed on the rear side of the conveyor belt 68 in a recording position for the recording medium P (side opposite to the recording medium P). Then, the conductive roller or the conductive platen is connected to the negative high voltage power source, thereby forming the electrostatic attraction means 70. Alternatively, it is also possible that the conveyor belt 68 is composed of an insulating belt and the conductive roller is grounded to connect the conductive platen to the negative high voltage power source.

The conveyor belt 68 conveys the recording medium P charged by the electrostatic attraction means 70 to the position where the head unit 80 to be described later is located.

The head unit 80 uses the ink jet head of the present invention to eject ink droplets in accordance with image data to thereby record an image on the recording medium P. As described above, the ink jet head of the present invention uses a charge potential of the recording medium P for the bias voltage and applies a drive voltage to the ejection electrodes 18, whereby the drive voltage is superposed on the bias voltage and the ink droplets R are ejected to record an image on the recording medium P. At this time, the conveyor belt 68 is provided with heating means to increase the temperature of the recording medium P, thus promoting fixation of the ink droplets R on the recording medium P and further suppressing ink bleeding, which leads to improvement in image quality.

Image recording using the head unit 80 and the like will be described in detail below.

The recording medium P on which the image is formed is discharged by the discharge means 72 and peeled off the conveyor belt 68 by the peeling means 74 before being conveyed to the fixation/conveyance means 76.

In the illustrated embodiment, the discharge means 72 is a so-called AC corotron discharger, which includes a corotron discharger 72*a*, an AC power source 72*b*, and a DC high voltage power source 72*c* with one end grounded. In addition thereto, various means and methods, for example, a scorotron discharger, a solid-state charger, and an electrostatic discharge needle can be used for discharge. Also, as in the electrostatic attraction means 70 described above, a structure using a conductive roller or a conductive platen can also be preferably utilized.

A known technique using a peeling blade, a counter-rotating roller, an air knife or the like is applicable to the peeling means 74.

The recording medium P peeled off the conveyor belt 68 is sent to the fixation/conveyance means 76 where the image formed by means of the ink jet recording is fixed. A pair of rollers composed of a heat roller 76*a* and a conveying roller 76*b* is used as the fixation/conveyance means 76 to heat and fix the recorded image while nipping and conveying the recording medium P.

The recording medium P on which the image is fixed is guided by the guide 78 and delivered to a delivered paper tray (not shown).

In addition to the heat roll fixation described above, examples of the heat fixation means include irradiation with infrared rays or using a halogen lamp or a xenon flash lamp, and general heat fixation such as hot air fixation using a heater. Further, in the fixation/conveyance means 76, it is also possible that the heating means is used only for heating, and the conveyance means and the heat fixation means are provided separately.

It should be noted that in the case of heat fixation, when a sheet of coated paper or laminated paper is used as the recording medium P, there is a possibility of causing a phenomenon called "blister" in which irregularities are formed on the sheet surface since moisture inside the sheet abruptly evaporates due to rapid temperature increase. To avoid this, it is preferable that a plurality of fixing devices be arranged, and at least one of power supply to the respective fixing devices and a distance from the respective fixing devices to the recording medium P be changed such that the temperature of the recording medium P gradually increases.

The printer 60 is preferably constructed such that no components will contact the image recording surface of the recording medium P at least during a time from the image recording with the head unit 80 until the completion of fixation with the fixation/conveyance means 76.

Further, the movement speed of the recording medium P at the time of fixation with the fixation/conveyance means 76 is not particularly limited, which may be the same as, or different from, the conveying speed by the conveyor belt 68 at the time of image formation. When the movement speed is different from the conveying speed at the time of image formation, it is also preferable to provide a speed buffer for the recording medium P immediately before the fixation/conveyance means 76.

Image recording using the printer 60 will be described below in detail.

As described above, the image recording means of the printer 60 includes the head unit 80 for ejecting ink, the ink circulation system 82 that supplies the ink Q to the head unit 80 and recovers the ink Q from the head unit 80, the head driver 84 that drives the head unit 80 based on an output image signal from a not-shown external apparatus such as a computer or a raster image processor (RIP), and the recording medium position detection means 86 for detecting the recording medium P in order to determine an image recording position on the recording medium P.

Figure 7B:
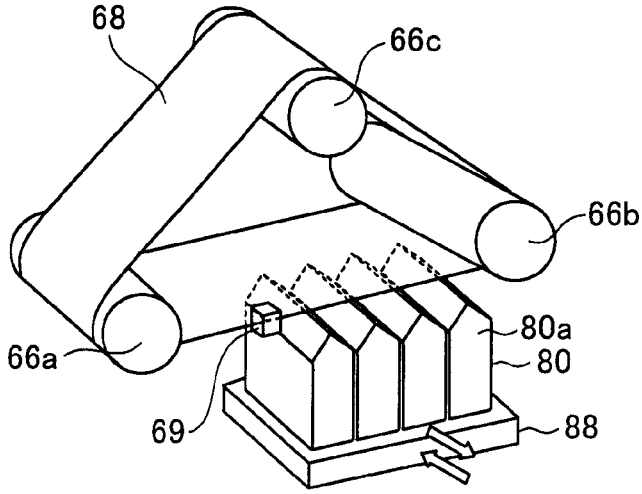
FIG. 7B is a perspective view schematically illustrating a head unit and conveyance means for conveying a recording medium provided on the periphery of the head unit.

FIG. 7B is a schematic perspective view showing the head unit 80 and the conveyor means for the recording medium P on the periphery thereof.

The head unit 80 includes four ink jet heads 80*a* for four colors of cyan (C), magenta (M), yellow (Y), and black (K) for recording a full-color image, and records an image on the recording medium P transported by the conveyor belt 68 at a predetermined speed by ejecting the ink Q supplied by the ink circulation system 82 as ink droplets R in accordance with signals from the head driver 84 to which image data was supplied. The ink jet heads 80*a* for the respective colors are arranged along a traveling direction of the conveyor belt 68.

Note that the ink jet head 80*a* for each color in the head unit 80 is the ink jet head of the present invention.

In the illustrated embodiment, each of the ink jet heads 80*a* is a line head including ejection ports 28 disposed in the entire area in the width direction of the recording medium P. The ink jet head 80*a* is preferably a multi-channel head as shown in FIG. 2A, which has multiple nozzle lines, arranged in a staggered shape.

Therefore, in the illustrated embodiment, while the recording medium P is held on the conveyor belt 68, the recording medium P is conveyed to pass over the head unit 80 once. In other words, scanning and conveyance are performed only once for the head unit 80. Then, an image is formed on the entire surface of the recording medium P. Therefore, image recording (drawing) at a higher speed is possible compared to serial scanning of the ejection head.

Note that the ink jet head of the present invention is also applicable to a so-called serial head (shuttle type head), and therefore the printer 60 may take this configuration.

In this case, the head unit 80 is structured such that a line (which may have a single line or multi channel structure) of the ejection ports 28 for each ink jet head agrees with the conveying direction of the conveyor belt 68, and the head unit 80 is provided with known scanning means which scans the head unit 80 in a direction perpendicular to the direction in which the recording medium P is conveyed.

Image recording may be performed as in a usual shuttle type ink jet printer. In accordance with the length of the line of the ejection ports 28, the recording medium P is conveyed intermittently by the conveyor belt 68, and in synchronization with this intermittent conveying, the head unit 80 is scanned when the recording medium is at rest, whereby an image is formed on the entire surface of the recording medium P.

As described above, the image formed by the head unit 80 on the entire surface of the recording medium P is then fixed by the fixation/conveyance means 76 while the recording medium P is nipped and conveyed by the fixation/conveyance means 76.

The head driver 84 receives image data from a system control portion (not shown) that receives image data from an external apparatus and performs various processing on the image data, and drives the head unit 80 based on the image data.

The system control portion color-separates the image data received from the external apparatus such as a computer, an RIP, an image scanner, a magnetic disk apparatus, or an image data transmission apparatus. The system control portion then performs division computation into an appropriate number of pixels and an appropriate number of gradations to generate image data with which the head driver 84 can drive the head unit 80 (ink jet head). Also, the system control portion controls timings of ink ejection by the head unit 80 in accordance with conveyance timings of the recording medium P by the conveyor belt 68. The ejection timings are controlled using an output from the recording medium position detection means 86 or an output signal from an encoder arranged for the conveyor belt 68 or a drive means of the conveyor belt 68.

The recording medium position detecting means 86 detects the recording medium P being fed to a position at which an ink droplet is ejected onto the medium P from the head unit 80, and known detecting means such as photo sensor can be used.

Here, when the number of the ejection portions to be controlled (the number of channels) is large as in the case where a line head is used, the head driver 84 may separate rendering to employ a known method such as resistance matrix type drive method or resistance diode matrix type drive method. Thus, it is possible to reduce the number of ICs used in the head driver 84 and suppress the size of a control circuit while lowering costs.

The ink circulating system 82 allows each ink Q to flow in the main ink flow path 30 (see FIG. 1A) of the corresponding ink jet head 80*a* of the head unit 80. For each of the ink of the four colors (C, M, Y, K), the ink circulating system 82 includes: an ink circulating device 82*a* having an ink tank, a pump, a replenishment ink tank (not shown), etc.; an ink supply system 82*b* for supplying the ink Q of each color from the ink tank of the ink circulating device 82*a* to the main ink flow path 30 of each ink jet head 80*a* of the head unit 80; and an ink recovery system 82*c* for recovering the ink Q from the main ink flow path 30 of each ink jet head 80*a* of the head unit 80 into the ink circulating device 82*a*.

An arbitrary system may be used for the ink circulating system 82 as long as this system supplies the ink Q of a color corresponding to each ink jet head 80*a* from the ink tank to the head unit 80 through the ink supply system 82*b* and recovers the ink from each ink jet head 80*a* to the ink tank through the ink recovery system 82*c* to allow ink circulation in a path for returning the ink into the corresponding ink tank.

Each ink tank contains the ink Q of the corresponding color and the ink Q is supplied to the head unit 80 by means of a pump. Ejection of the ink from the head unit 80 lowers the concentration of ink circulating in the ink circulating system 82. Therefore, it is preferable in the ink circulating system 82 that the ink concentration be detected by an ink concentration detecting device and the ink tank be replenished as appropriate with ink from the replenishment ink tank to keep the ink concentration in a predetermined range.

Moreover, the ink tank is preferably provided with an agitator for suppressing precipitation/aggregation of solid components of the ink and an ink temperature control device for suppressing ink temperature change. When the ink temperature changes due to ambient temperature change or the like, physical properties of the ink are changed, which causes the dot diameter change. As a result, a high quality image may not be recorded with stability.

A rotary blade, an ultrasonic transducer, a circulation pump, or the like may be used for the agitator.

The head unit 80, the ink tank, an ink supply line and other components are provided with a heating element such as a heater or a cooling element such as Peltier element as the ink temperature control device, and any known method, for example, a method in which control is performed with a temperature sensor like a thermostat can be used. When arranged inside the ink tank, the temperature control device is preferably arranged with the agitator such that temperature distribution is kept constant. Then, the agitator for keeping the concentration distribution in the tank constant may double as the agitator for suppressing the precipitation/aggregation of solid components of the ink.

As described above, the printer 60 includes solvent collecting means composed of the discharge fan 90 and the solvent collecting device 92. The solvent collecting means collects the carrier liquid evaporated from the ink droplets ejected on the recording medium P from the head unit 80, in particular, the carrier liquid evaporated from the recording medium P at the time of fixing the image formed of the ink droplets.

The discharge fan 90 sucks air inside the casing 61 of the printer 60 to blow the air to the solvent collecting device 92.

The solvent collecting device 92 is provided with a solvent vapor absorber. This solvent vapor absorber absorbs solvent components of gas containing solvent vapor sucked by the discharge fan 90, and exhausts the gas whose solvent has been absorbed and collected, to the outside of the casing 61 of the printer 60. Various active carbons are preferably used as the solvent vapor absorber.

While the electrostatic ink jet recording apparatus for recording a color image using the ink of four colors including C, M, Y, and K has been described, the present invention should not be construed restrictively; the apparatus may be a recording apparatus for a monochrome image or an apparatus for recording an image using an arbitrary number of other colors such as pale color ink and special color ink, for example. In such a case, the head units 80 and the ink circulating systems 82 whose number corresponds to the number of ink colors are used.

Furthermore, in the above embodiments, the ink jet recording in which the ink droplets R are ejected by positively charging the colorant particles in the ink and charging the recording medium P or the counter electrode on the rear side of the recording medium P to the negative high voltage has been described. However, the present invention is not limited to this. The ink jet image recording may be performed by negatively charging the colorant particles in the ink and charging the recording medium or the counter electrode to the positive high voltage. When the charged color particles have the polarity opposite to that in the above-mentioned case, the applied voltage to the electrostatic attraction means, the counter electrode, the drive electrode of the ink jet head, or the like is changed to have the polarity opposite to that in the above-mentioned case.

The ink jet head and the ink jet recording apparatus according to the present invention are not limited to the electrostatic type but can be applied to various ink jet heads and ink jet recording apparatuses of thermal type, piezoelectric type or the like.

The ink jet head and the ink jet recording apparatus using the ink jet head according to the present invention have been described in detail, but the present invention is not limited to the above embodiments. It will be obvious that various modifications and changes can be made without departing from the scope of the present invention.

What is claimed is:

1. An ink jet head comprising:

a plate-like substrate having an ejection port bored through said plate-like substrate;

an ink guide formed of a flat plate and provided at a position corresponding to said ejection port of said plate-like substrate, a tip portion of said ink guide having an upwardly tapered and convex shape, penetrating through and beyond said ejection port and projecting from said ejection port so as to be disposed on an ink ejecting side of said ejection port substrate, and said ejection port and said tip portion of said ink guide forming an ink meniscus; and an ejection means for ejecting ink of said ink meniscus formed by said tip portion of said ink guide and said ejection port as ink droplets, wherein a periphery of said ejection port convexly projects in a ring shape on said plate-like substrate so as to surround said ejection port and project upwardly from an upper surface of said plate-like substrate along an ejection direction of said ink droplets to form a convexly-projecting portion, wherein a tip portion of the convexly-projecting portion of said periphery of said ejection port that convexly projects along said ejection direction has an acute angle, wherein said ink meniscus is held by said tip portion of said ink guide and the acute angled tip portion of said convexly-projecting portion of said periphery of said ejection port, wherein parts of said convexly-projecting portion of said periphery of said ejection port are removed by a predetermined width, and wherein removed portions are provided at both sides of a convex portion of said tip portion of said ink guide disposed in parallel to ink flow, said both sides of said convex portion disposed on an ink inflow side and an ink outflow side of said ejection port.

2. The ink jet head according to claim 1, wherein the acute angle of the tip portion of the convexly-projecting portion is defined by a surface of the convexly-projecting portion that is parallel with said ejection direction and an uppermost surface of the convexly-projecting portion of said periphery of said ejection port that convexly projects along said ejection direction.

3. The ink jet head according to claim 1, wherein said convexly-projecting portion is a part of said plate-like substrate.

4. The ink jet head according to claim 1, wherein said ink droplets are ejected from said ejection port by causing an electrostatic force to act on ink.

5. The ink jet head according to claim 1, wherein a height of the convexly-projecting portion is preferably in a range of 10 μm to 500 μm.

6. An ink jet recording apparatus for recording an image corresponding to image data on a recording medium using an ink jet head according to claim 1.

7. An ink jet head for ejecting ink droplets by causing an electrostatic force to act on ink containing charged colorant particles, comprising:

an ejection port substrate having an ejection port bored through said ejection port substrate;

a head substrate disposed at a predetermined distance apart from said ejection port substrate to form an ink flow path between said ejection port substrate and said head substrate;

an ink guide formed of a flat plate and provided in said head substrate at a position corresponding to said ejection port of said ejection port substrate, a tip portion of said ink guide having an upwardly tapered and convex shape, penetrating through and beyond said ejection port, projecting from said ejection port so as to be disposed further away from said head substrate than said ejection port, and forming an ink meniscus of said ink with said ejection port; and an ejection electrode formed in correspondence to said ejection port on said ejection port substrate for ejecting ink of said ink meniscus formed by said tip portion of said ink guide and said ejection port as said ink droplets by causing said electrostatic force to act on said ink, wherein a periphery of said ejection port convexly projects in a ring shape on said ejection port substrate so as to surround said ejection port of said ejection port substrate and project upwardly from an upper surface of said ejection port substrate along an ejection direction of said ink droplets to form a convexly-projecting portion, parts of said convexly projecting portion of said periphery of said ejection port are removed by a predetermined width, thereby forming removed portions, and said removed portions correspond to both sides of a convex portion of said tip portion of said ink guide disposed in parallel to ink flow of said ink flow path, said both sides of said convex portion disposed on an ink inflow side and an ink outflow side of said ejection port, wherein a tip portion of a convexly-projecting portion of said periphery of said ejection port that convexly projects along said ejection direction has an acute angle, and wherein said ink meniscus is held by said tip portion of said ink guide and the acute angled tip portion of said convexly-projecting portion of said periphery of said ejection port.

8. An ink jet head for ejecting ink droplets by causing an electrostatic force to act on ink containing charged colorant particles, comprising:

an ejection port substrate having an ejection port bored through said ejection port substrate;

a head substrate disposed at a predetermined distance apart from said ejection port substrate to form an ink flow path between said ejection port substrate and said head substrate;

an ink guide formed of a flat plate and provided in said head substrate at a position corresponding to said ejection port of said ejection port substrate, a tip portion of said ink guide having an upwardly tapered and convex shape, penetrating through and beyond said ejection port, projecting from said ejection port so as to be disposed further away from said head substrate than said ejection port, and forming an ink meniscus of said ink with said ejection port; and an ejection electrode formed in correspondence to said ejection port on said ejection port substrate for ejecting ink of said ink meniscus formed by said tip portion of said ink guide and said ejection port as said ink droplets by causing said electrostatic force to act on said ink, wherein a periphery of said ejection port convexly projects in a ring shape on said ejection port substrate so as to surround said ejection port on said ejection port substrate and project upwardly from an upper surface of said ejection port substrate along an ejection direction of said ink droplets to form a convexly-projecting portion, parts of said convexly-projecting portion of said periphery of said ejection port are removed by a predetermined width thereby forming removed portions, said removed portions corresponding to both sides of a convex portion of said tip portion of said ink guide disposed in parallel to said ink flow, said both sides of said convex portion disposed on an ink inflow and an ink outflow side of said ejection port, and wherein said ink meniscus is held by said tip portion of said ink guide and said convexly-projecting portion of said periphery of said ejection port.

9. The ink jet head according to claim 8, wherein an angle between a surface parallel with said ejection direction and an uppermost surface of a convexly-projecting portion of said periphery of said ejection port that convexly projects along said ejection direction is an acute angle.

10. The ink jet head according to claim 8, wherein said convexly-projecting portion is a part of said plate-like substrate.

11. The ink jet head according to claim 8, wherein a height of the projecting portion is in a range of 10 μm to 500 μm.

12. An ink jet recording apparatus for recording an image corresponding to image data on a recording medium using an ink jet head according to claim 8.

13. The ink jet head according to claim 8, further comprising a guard electrode disposed on said ejection port substrate so as to cover among adjacent ejection electrodes and having larger openings than openings of said ejection electrodes, thereby suppressing electric field interference among said adjacent control electrodes.

14. The ink jet head according to claim 8, wherein a part of a lower side of said ejection port substrate in a periphery of said ejection port is removed and said ejection port substrate in said periphery of said ejection port is thinner than a thickness of the rest of said ejection port substrate.

* * * * *